US008850724B2

(12) United States Patent
Bloxdorf

(10) Patent No.: US 8,850,724 B2
(45) Date of Patent: Oct. 7, 2014

(54) PLOW WITH PIVOTING BLADE WING

(71) Applicant: Douglas Dynamics, L.L.C., Milwaukee, WI (US)

(72) Inventor: David N. Bloxdorf, Hubertus, WI (US)

(73) Assignee: Douglas Dynamics, L.L.C., Milwaukee, WI (US)

( * ) Notice: Subject to any disclaimer, the term of this patent is extended or adjusted under 35 U.S.C. 154(b) by 0 days.

(21) Appl. No.: 13/768,884

(22) Filed: Feb. 15, 2013

(65) Prior Publication Data

US 2014/0230290 A1 Aug. 21, 2014

(51) Int. Cl.
*A01B 59/04* (2006.01)
*E01H 5/06* (2006.01)

(52) U.S. Cl.
CPC ..... *E01H 5/067* (2013.01); *E01H 5/063* (2013.01)
USPC ..... 37/283; 37/281; 172/815

(58) Field of Classification Search
CPC ..... E02F 3/8155; E01H 5/06; E01H 5/061; E01H 5/062; E01H 5/063; E01H 5/065; E01H 5/067
USPC ..... 37/274, 281, 266, 279, 283; 172/815
See application file for complete search history.

(56) References Cited

U.S. PATENT DOCUMENTS

| | | | |
|---|---|---|---|
| 595,202 | A | 12/1897 | Pearson et al. |
| 1,927,078 | A | 9/1933 | Weeks |
| 2,218,512 | A | 10/1940 | Ball |
| 2,299,451 | A | 10/1942 | Austin |
| 2,410,543 | A | 11/1946 | Kester |
| 2,524,329 | A | 10/1950 | Richardson |
| 2,643,470 | A | 6/1953 | Kaeser |
| 3,157,099 | A | 11/1964 | Ulrich |
| 3,250,026 | A | 5/1966 | Jocher et al. |
| 3,302,317 | A | 2/1967 | Domres |
| 3,378,084 | A | 4/1968 | Ulrich |
| 3,425,497 | A | 2/1969 | Strabala et al. |

(Continued)

FOREIGN PATENT DOCUMENTS

| | | |
|---|---|---|
| DE | 919474 | 7/1949 |
| EP | 140139 | 5/1985 |
| GB | 1037674 | 8/1966 |
| SE | 323974 | 5/1970 |

OTHER PUBLICATIONS

Farm Industry News, vol. 23, No. 7, Jul./Aug. 1990, p. 25.

(Continued)

*Primary Examiner* — Matthew D Troutman
(74) *Attorney, Agent, or Firm* — Wood, Herron & Evans, LLP

(57) ABSTRACT

A plow assembly for attachment to a vehicle having a longitudinal axis comprises a plow blade having first and second ends, a first plow wing pivotally mounted to the first end of the plow blade, and a plow support adapted to be operably mounted to the vehicle. The first plow wing is biased by a first compression. A first connecting member is connected to the first plow wing, passes through the first compression spring generally coaxially therewith, and is connected to the plow support. The first connecting member is configured to pivot the first plow wing relative to the plow blade during pivoting of the plow blade from a center position to a first position such that when the plow blade is in the first position the first plow wing is generally parallel to the plow blade.

15 Claims, 12 Drawing Sheets

(56) References Cited

U.S. PATENT DOCUMENTS

| | | | |
|---|---|---|---|
| 3,430,706 | A | 3/1969 | Marron |
| 3,477,151 | A | 11/1969 | Zanella |
| 3,657,828 | A | 4/1972 | Anderson |
| 3,775,877 | A | 12/1973 | Gove, Sr. |
| 3,803,733 | A | 4/1974 | Ramsey |
| 3,807,064 | A | 4/1974 | Schmidt et al. |
| 4,019,268 | A | 4/1977 | Watterman |
| 4,073,077 | A | 2/1978 | Essell et al. |
| 4,074,448 | A | 2/1978 | Niemela |
| 4,099,578 | A | 7/1978 | Stevens |
| 4,145,825 | A | 3/1979 | Bertolino |
| 4,196,532 | A | 4/1980 | Muller |
| 4,249,323 | A | 2/1981 | Mathis et al. |
| 4,275,514 | A | 6/1981 | Maura |
| RE31,045 | E | 10/1982 | Essell et al. |
| 4,356,645 | A | 11/1982 | Hine et al. |
| 4,369,847 | A | 1/1983 | Mizunuma |
| 4,372,617 | A | 2/1983 | Zamboni |
| 4,479,312 | A | 10/1984 | Turgeon |
| 4,614,048 | A | 9/1986 | Melby |
| 4,658,519 | A | 4/1987 | Quenzi |
| 4,667,426 | A | 5/1987 | Howard et al. |
| 4,723,609 | A | 2/1988 | Curtis |
| 4,779,363 | A | 10/1988 | Boutrais et al. |
| 4,834,191 | A | 5/1989 | Vecchio |
| 4,962,600 | A | 10/1990 | Zellaha et al. |
| 5,165,191 | A | 11/1992 | Davis |
| 5,285,588 | A | 2/1994 | Niemela et al. |
| 5,375,349 | A | 12/1994 | Jochim |
| 5,392,538 | A | 2/1995 | Geerligs et al. |
| 5,411,102 | A | 5/1995 | Nickels et al. |
| 5,638,618 | A | 6/1997 | Niemela et al. |
| 5,829,174 | A | 11/1998 | Hadler et al. |
| 5,899,007 | A | 5/1999 | Niemela et al. |
| 5,903,986 | A | 5/1999 | Parker |
| 6,178,669 | B1 | 1/2001 | Quenzi et al. |
| 6,276,076 | B1 | 8/2001 | Quenzi et al. |
| 6,393,737 | B2 | 5/2002 | Quenzi et al. |
| 6,408,549 | B1 | 6/2002 | Quenzi et al. |
| 6,412,199 | B1 | 7/2002 | Quenzi et al. |
| 6,442,877 | B1 | 9/2002 | Quenzi et al. |
| 6,463,683 | B1 | 10/2002 | Skwarchuk |
| 6,615,513 | B2 | 9/2003 | Quenzi et al. |
| 7,134,227 | B2 | 11/2006 | Quenzi et al. |
| 8,607,482 | B2 * | 12/2013 | Bloxdorf ..... 37/274 |
| 2004/0216333 | A1 * | 11/2004 | Quenzi et al. ..... 37/281 |
| 2007/0068049 | A1 * | 3/2007 | Quenzi et al. ..... 37/274 |
| 2012/0216434 | A1 | 8/2012 | Bloxdorf |

OTHER PUBLICATIONS

"Still Out in Front in Productivity," Excel Industries, Inc., copyright 1988.

"Snow Track 440," Excel Industries, 1989.

* cited by examiner

PLOW WITH PIVOTING BLADE WING

RELATED APPLICATIONS

N/A

FIELD OF THE INVENTION

This invention relates generally to plows, and more particularly to snow plows of the type having a wing mounted for pivoting movement on one or both of the ends of the blade of the snow plow.

BACKGROUND OF THE INVENTION

Snow plows of the type having a wing mounted for pivoting movement on one or both of the ends of the blade of the snow plow are known. One example of an improved version of such a plow is shown and described in U.S. Pat. No. 7,134,227, assigned to the assignee of the present invention, and hereby incorporated by reference herein. The '227 patent discloses a plow having a plow blade and a pair of plow wings pivotally mounted at opposite ends of the plow blade. The wings are pivotable between a forwardly angled position relative to the plow blade and an aligned position relative to the plow blade. Various mechanisms, both mechanical and hydraulic, are provided for pivoting the trailing wing from the forwardly angled position to the aligned position as the blade end to which the trailing wing is mounted is pivoted toward the vehicle.

Another example of an improved version of such a plow is shown and described in US Patent Application Publication No. 2012/0216434, assigned to the assignee of the present invention, and hereby incorporated by reference herein. The '434 publication discloses various additional mechanisms such as a single link rod, a resilient connecting member, or a cam and follower mechanism, connected to the plow wing and to the plow support for pivoting the trailing wing from the forwardly angled position to the aligned position as the blade end to which the trailing wing is mounted is pivoted toward the vehicle.

Despite the above-noted advancements made in the area of plows with blade wings, there remains room for improvement.

SUMMARY OF THE INVENTION

In one aspect, a plow assembly for attachment to a vehicle having a longitudinal axis, is provided. The plow assembly comprises a plow blade having first and second ends, a first plow wing pivotally mounted to the first end of the plow blade, and a plow support adapted to be operably mounted to the vehicle. The plow blade is operably pivotally mounted to the plow support to permit the plow blade to pivot relative to the vehicle about a generally vertical axis between a center position, where the plow blade is positioned generally perpendicular to the longitudinal axis of the vehicle, and a first position, where the first end of the plow blade is pivoted toward the vehicle, and between the center position and a second position, where the second end of the plow blade is pivoted toward the vehicle. The first plow wing is biased by a first compression spring operable between the first plow wing and the plow blade so as to be angled forwardly relative to the plow blade when the plow blade is in the center position. A first connecting member is connected to the first plow wing, passes through the first compression spring generally coaxially therewith, and is connected to the plow support. The first connecting member is configured to pivot the first plow wing relative to the plow blade during pivoting of the plow blade from the center position to the first position such that when the plow blade is in the first position the first plow wing is generally parallel to the plow blade.

The first connecting member can comprise a first flexible cable. The first flexible cable can have a first end connected to the plow support at a location forward of the generally vertical pivot axis and between the generally vertical pivot axis and the first end of the plow blade, and a second end connected to the first plow wing at a location rearward of a pivot axis of the first plow wing. The first flexible cable is in tension when the plow blade is in the first position and can be slack when the plow blade is in the second position. The plow support can comprise an A-frame having a forward end and a rearward end, the plow blade operably pivotally mounted to the forward end of the A-frame, the rearward end of the A-frame adapted to be operably mounted to the vehicle. The plow blade can be pivotally mounted to a pivot beam so as to permit the plow blade to pivot relative to the vehicle about a generally horizontal axis generally transverse to the vehicle longitudinal axis to trip in the event the blade strikes an obstruction during plowing, and the pivot beam can be pivotally mounted to the A-frame for pivoting movement about the generally vertical axis. The first compression spring, the first flexible cable, and the generally horizontal trip pivot axis can all advantageously be generally coaxial.

The plow assembly can further comprise a second plow wing pivotally mounted to the second end of the plow blade, the second plow wing being biased by a second compression spring operable between the second plow wing and the plow blade so as to be angled forwardly relative to the plow blade when the plow blade is in the center position, and a second connecting member connected to the second plow wing, passing through the second compression spring generally coaxially therewith, and connected to the plow support. The second connecting member is also configured to pivot the second plow wing relative to the plow blade during pivoting of the plow blade from the center position to the second position such that when the plow blade is in the second position the second plow wing is generally parallel to the plow blade. The second connecting member can also comprise a second flexible cable. The second flexible cable can also have a first end connected to the plow support at a location forward of the generally vertical pivot axis and between the generally vertical pivot axis and the second end of the plow blade, and a second end connected to the second plow wing at a location rearward of a pivot axis of the second plow wing. The second flexible cable is also in tension when the plow blade is in the second position and can be slack when the plow blade is in the first position. The second compression spring, second flexible cable, and the generally horizontal trip pivot axis can also all advantageously be generally coaxial. The plow assembly can further comprise a first actuator connected to the A-frame and to the pivot beam between the longitudinal axis of the vehicle and the first end of the plow blade, and a second actuator connected to the A-frame and to the pivot beam between the longitudinal axis of the vehicle and the second end of the plow blade, for pivoting the pivot beam about the generally vertical axis.

The accompanying drawings, which are incorporated in and constitute a part of this specification, illustrate embodiments of the invention and, together with the summary of the invention given above, and the detailed description of the drawings given below, serve to explain the principles of the present invention.

DETAILED DESCRIPTION OF THE DRAWINGS

Figure 1A:
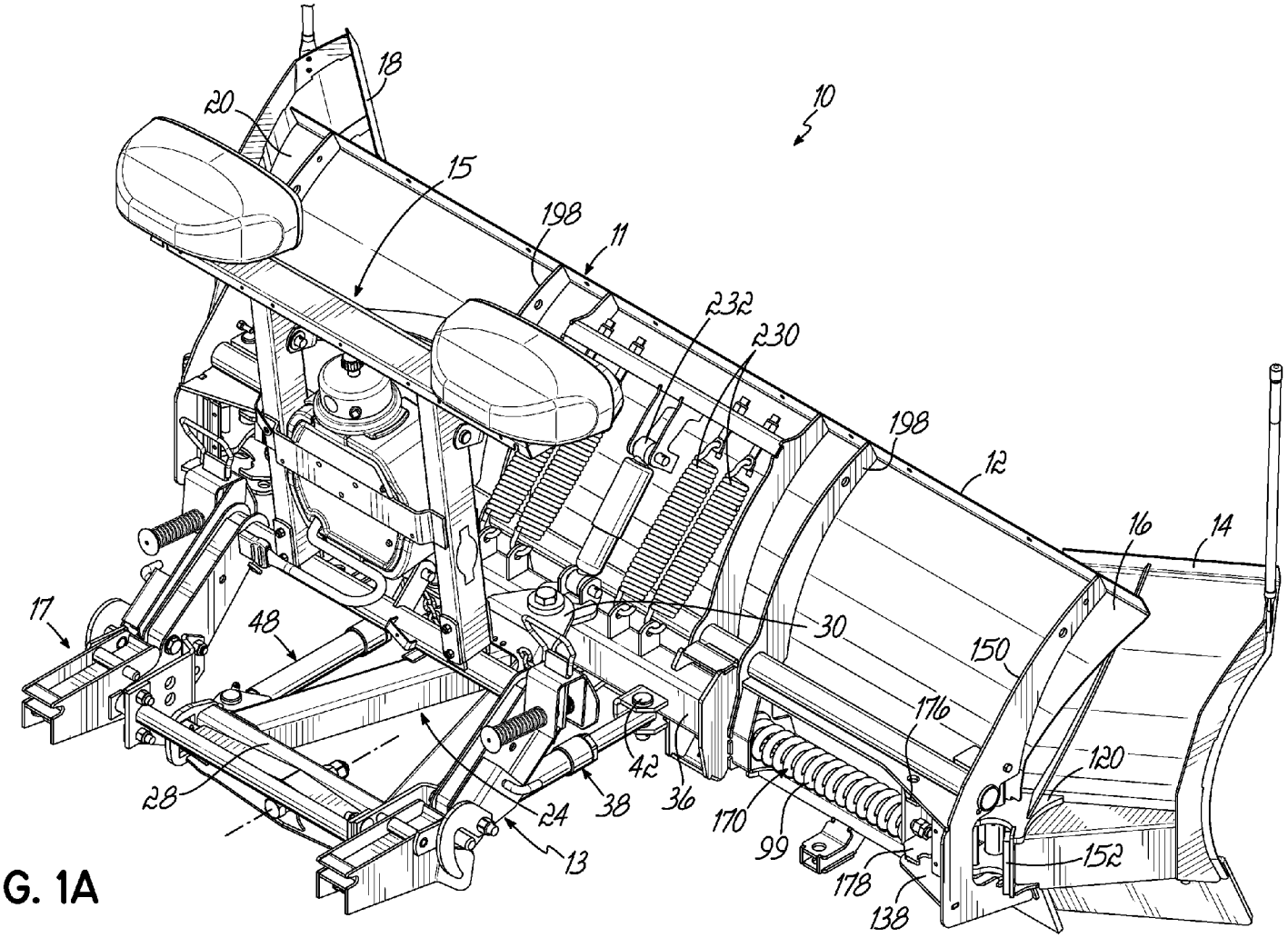
FIG. 1A is a rear perspective view of a plow assembly according to the principles of the present invention illustrating the plow blade positioned generally perpendicular to the longitudinal axis of the vehicle and the first and second wings angled forwardly relative to the plow blade.
Figure 1B:
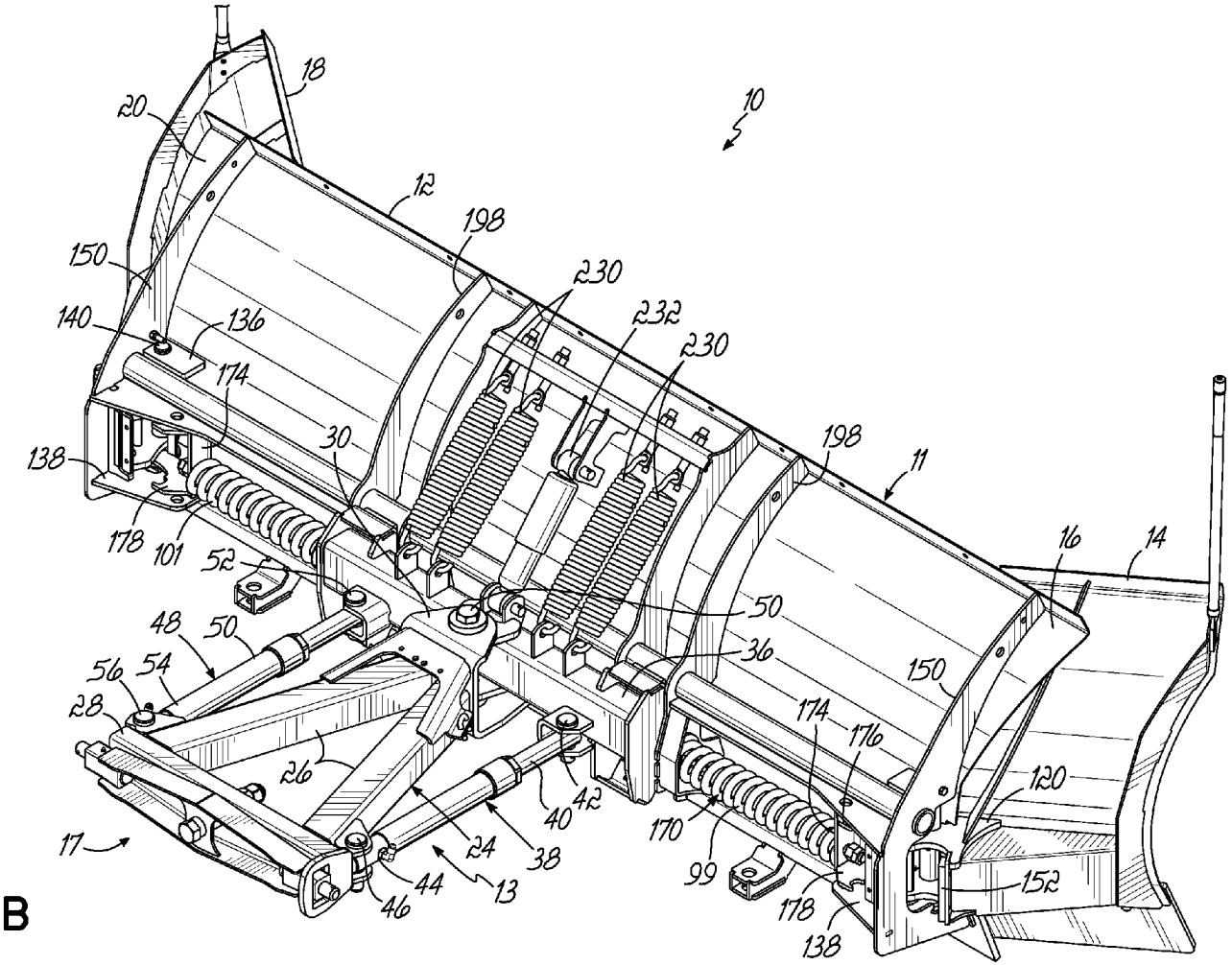
FIG. 1B is a view similar to FIG. 1A but with the plow lift frame and vehicle mount frame removed for clarity.
Figure 5:
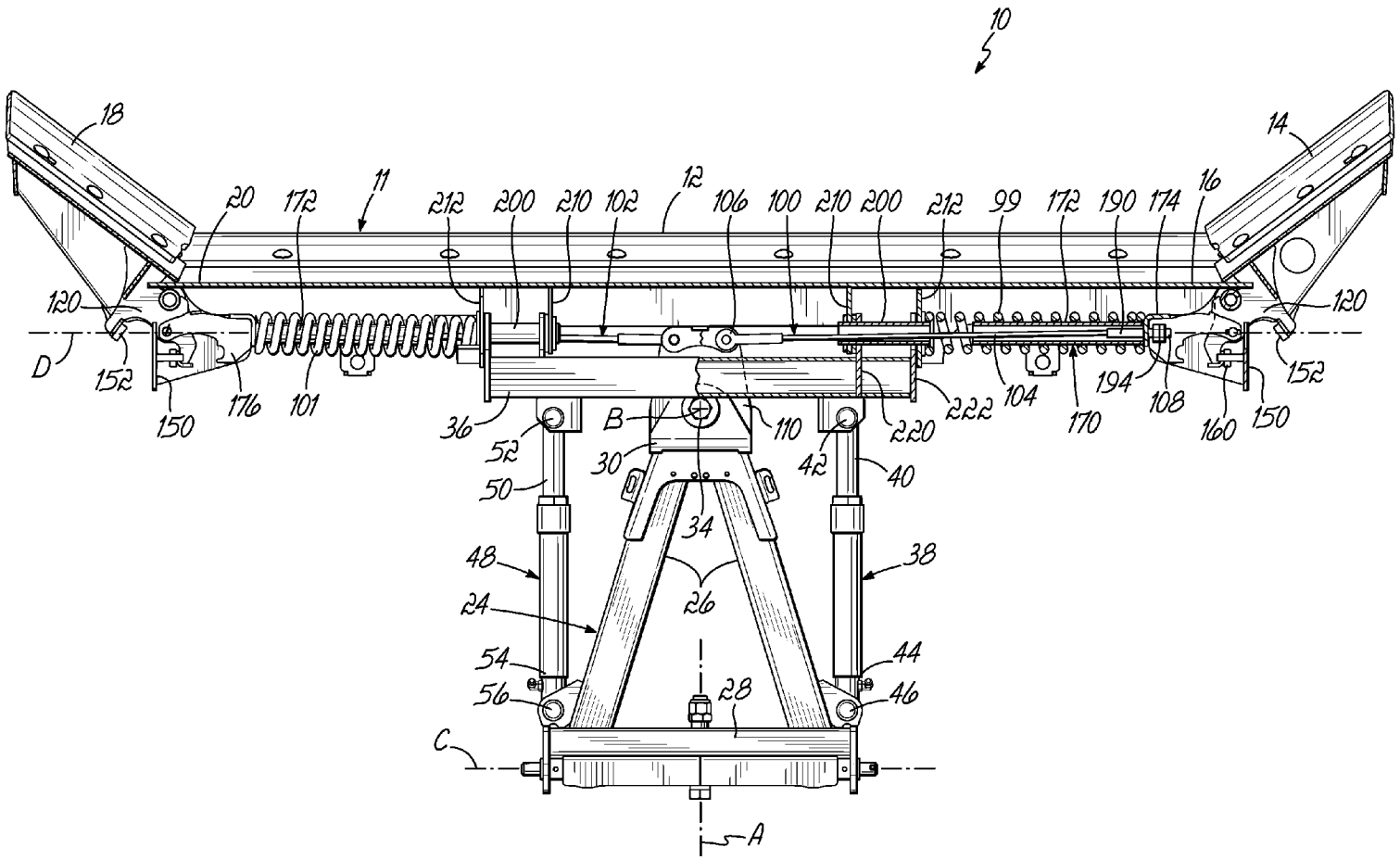
FIG. 5 is a cross-sectional view taken along a transverse horizontal plane in FIG. 1B.

Referring first to FIGS. 1A and 5, a plow assembly 10 according to the principles of the present invention and for removable attachment to a vehicle, the vehicle having a longitudinal axis A, is shown. Plow assembly 10 has a blade assembly 11, a support frame assembly 13, and a lift frame assembly 15. The blade assembly 11 is pivotally connected to the support frame assembly 13 on or near a front end of the support frame assembly 13 for pivotal movement relative to the vehicle about a generally vertical axis B. The support frame assembly 13 includes hydraulic actuators and associated structure for pivoting the blade assembly 11 about the generally vertical axis B as will be described in further detail below. The support frame assembly 13 is pivotally connected to the lift frame assembly 15 on or near a rear end of the support frame assembly 13 for pivotal movement of the support frame assembly 13 relative to the vehicle about a generally horizontal axis C generally transverse to the vehicle longitudinal axis A. The lift frame assembly 15 includes a hydraulic actuator and associated structure for lifting and lowering the support frame assembly 13 and hence blade assembly 11. The lower rear end of the lift frame assembly 15 interfaces with a vehicle mount frame assembly 17 that is mounted to the frame of the vehicle thereby permitting the snow plow assembly 10 to be removably mounted to the vehicle. For additional details of a suitable support frame assembly 13, lift frame assembly 15, and vehicle mount frame assembly 17, reference may be had to the assignee's U.S. Pat. No. 6,526,677, hereby incorporated by reference herein as if fully set forth in its entirety.

Referring now to FIGS. 1B-2C and 5, the blade assembly 11 as illustrated comprises a plow blade 12, a first plow wing 14 pivotally mounted to a first end 16 of the plow blade 12, and a second plow wing 18 pivotally mounted to a second end 20 of the plow blade 12. While two plow wings are illustrated, it is to be understood that the invention can be practiced with just one such plow wing, and thus the invention is not to be limited as requiring two plow wings. And, since the first and second plow wings 14, 18 and their associated structures are substantially the same, only the first plow wing 14 and its associated structure will be described in detail below.

The support frame assembly 13 can include, for example, an "A-frame" 24 having legs 26, 26 connected by a base 28 on their rearward ends and having forward ends connected together. A large clevis 30 can be connected to the forward ends of the legs 26, 26. The plow blade 12 can be pivotally mounted to a pivot beam 36 so as to permit the plow blade 12 to pivot relative to the pivot beam 36 and hence vehicle about a generally horizontal axis D generally transverse to the vehicle longitudinal axis A as will be described in further detail below. This provides a trip function, permitting the plow blade 12 to "trip" in the event that it strikes an obstruction during plowing. The pivot beam 36 can in turn be pivotally mounted to the clevis 30 of the A-frame 24 via a pivot pin 34 for pivoting movement about the generally vertical axis B.

Figure 2A:
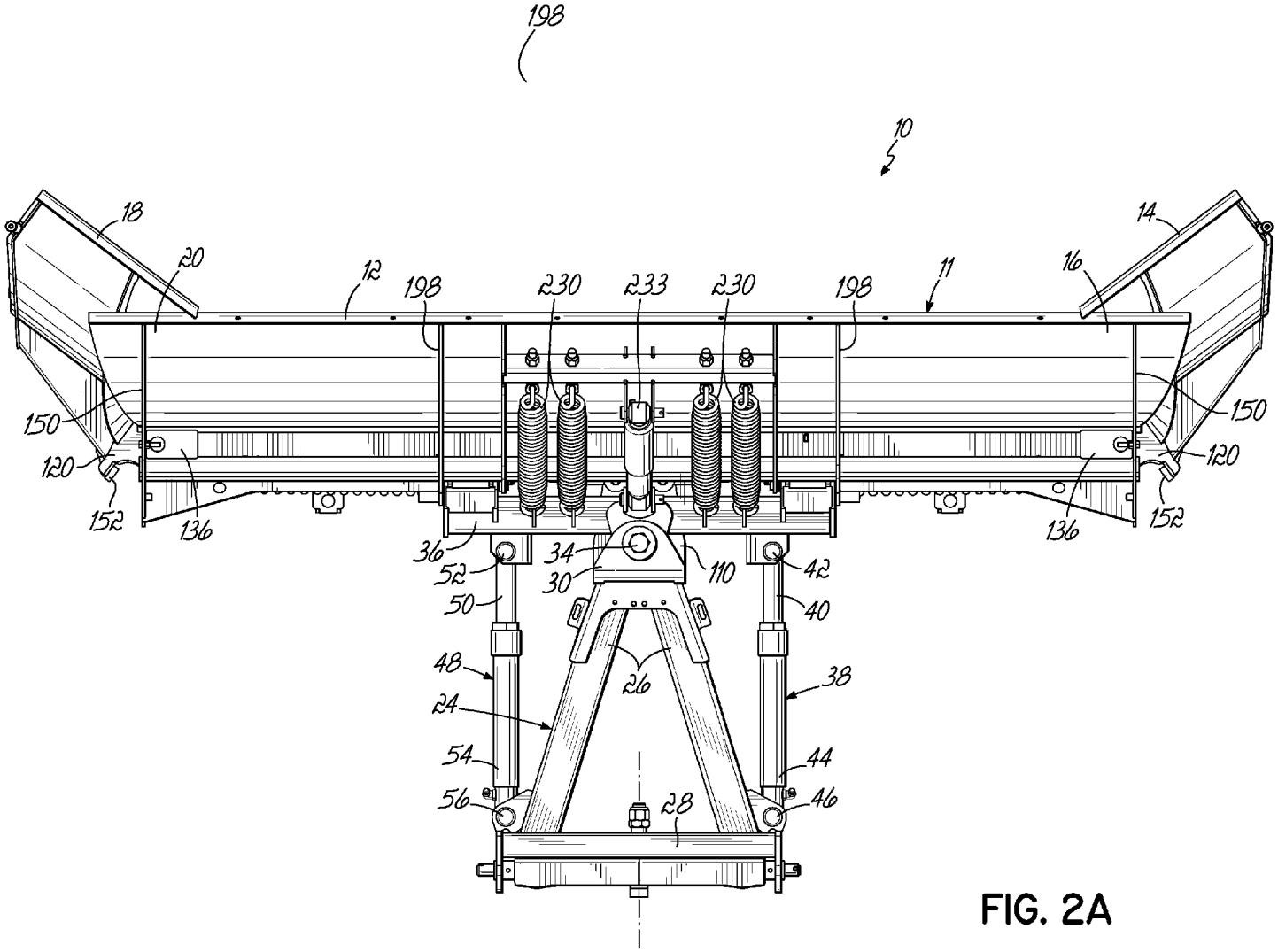
FIG. 2A is a top view of the plow assembly of FIG. 1B.
Figure 2B:
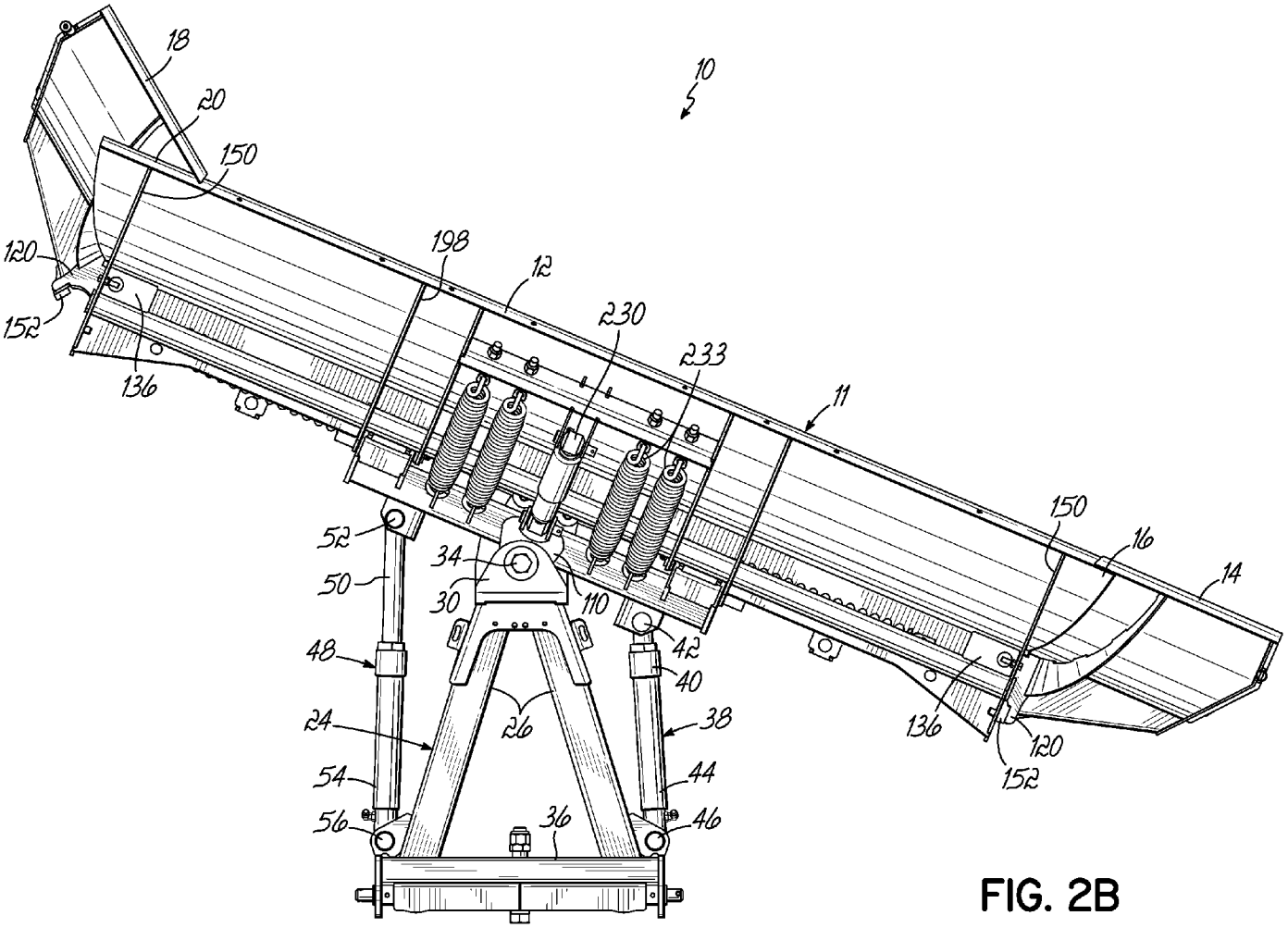
FIG. 2B is a top view of the plow assembly of FIG. 1B with the plow blade pivoted to the first position where the first end of the plow blade is pivoted toward the vehicle, the first plow wing is generally parallel to the plow blade, and the second plow wing is angled forwardly relative to the plow blade.
Figure 2C:
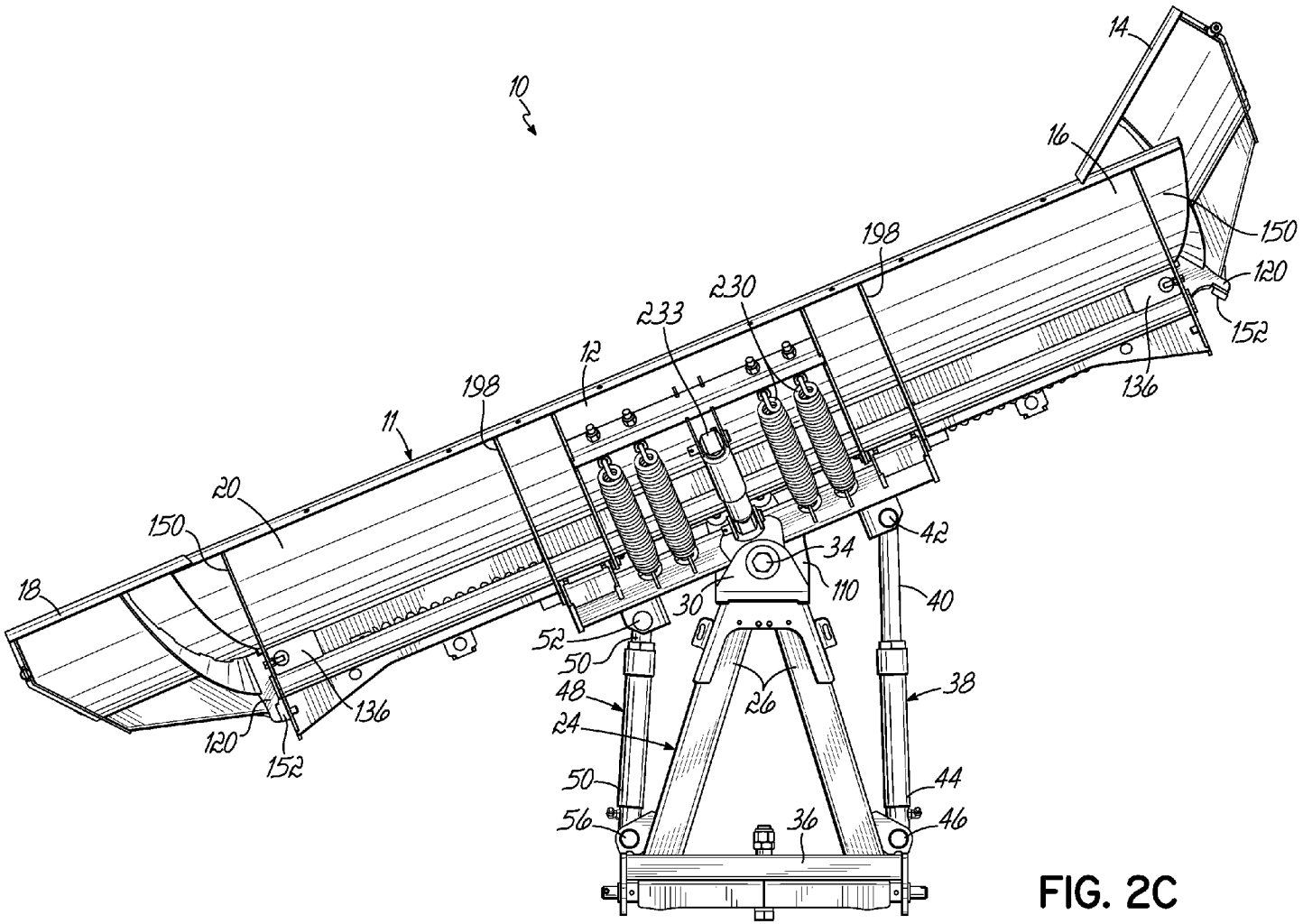
FIG. 2C is a top view of the plow assembly of FIG. 1B with the plow blade pivoted to the second position where the second end of the plow blade is pivoted toward the vehicle, the first plow wing is angled forwardly relative to the plow blade, and the second plow wing is generally parallel to the plow blade.

The plow assembly 10 can further comprise a first actuator 38, for example hydraulic cylinder, connected so as to be operable between the plow blade 12 and to the A-frame 24. More particularly, the first actuator 38 has a first end 40 pivotally connected to the pivot beam 36 of the plow blade 12 with a pin 42, and a second end 44 pivotally connected to the A-frame 24 with a pin 46, with both connections located between the longitudinal axis of the vehicle and the first end 16 of the plow blade 12. The plow assembly 10 can further comprise a second actuator 48, for example hydraulic cylinder, connected to the plow blade 12 and to the A-frame 24. The second actuator 48 has a first end 50 pivotally connected to the pivot beam 36 of the plow blade 12 with a pin 52, and a second end 54 pivotally connected to the A-frame 24 with a pin 56, with both connections located between the longitudinal axis of the vehicle and the second end 20 of the plow blade 12. By appropriate actuation of the actuators 38 and 48, the plow blade 12 is thus pivotal relative to the vehicle about the generally vertical axis B between a center position, where the plow blade 12 is positioned generally perpendicular to the longitudinal axis of the vehicle (FIG. 2A), and a first position, where the first end 16 of the plow blade 12 is pivoted toward the vehicle thus becoming the "trailing end" of the plow blade 12 in the first position (FIG. 2B), and between the center position and a second position, where the second end 20 of the plow blade 12 is pivoted toward the vehicle thus becoming the "trailing end" of the plow blade 12 in the second position (FIG. 2C). Consequently, placing the plow blade 12 in the first position (FIG. 2B) causes the first plow wing 14 to become the "trailing wing," and placing the plow blade 12 in the second position (FIG. 2C) causes the second plow wing 18 to become the "trailing wing."

Referring now to FIGS. 3A-7, the plow assembly 10 further comprises a first compression spring 99 operable between the first plow wing 14 and the plow blade 12 so as to angle the first plow wing 14 forwardly relative to the plow blade 12 when the plow blade 12 is in the center position. A suitable angle by which to angle the first plow wing 14 forwardly relative to the plow blade 12 while in the center position is about 38 degrees. The plow assembly 10 further comprises a first connecting member 100 connected to the first plow wing 14, passing through the first compression spring 99 generally coaxially therewith, and connected to the A-frame 24. Note that, in the event that the plow assembly 10 includes both a first plow wing 14 and a second plow wing 18, then the plow assembly 10 would further comprise a second compression spring 101 and a second connecting member 102 connected to the second plow wing 18 and to the A-frame 24. As mentioned above, since the first and second plow wings 14, 18 and their associated structures are substantially the same, only the first plow wing 14 and its associated structure will be described in detail.

The first connecting member 100 is configured to pivot the first plow wing 14 relative to the plow blade 12 during pivoting of the plow blade 12 from the center position (FIG. 2A) to the first position (FIG. 2B) such that when the plow blade 12 is in the first position the first plow wing 14 is generally parallel to the plow blade 12. The first connecting member 100 is also configured such that pivoting the plow blade 12 back to the center position (FIG. 2A) permits the first compression spring 99 to return the first plow wing 14 back to its forwardly angled position relative to the plow blade 12, where it will remain during pivoting of the plow blade 12 to the second position (FIG. 2C).

More particularly, the first connecting member 100 preferably comprises a first flexible cable 104 connected to the first plow wing 14 and to the A-frame 24. The flexible cable 104 has a first end 106 and a second end 108. First end 106 can be connected to a lower plate 110 of clevis 30, and the second end 108 is operably connected to first plow wing 14 as will be subsequently described.

The length of the flexible cable 104 and the location of the connections of its ends 106, 108 relative to the vertical pivot axis B of the plow blade 12 and the pivot axis of the plow wing 14 relative to the blade 12 can be selected to produce the desired motion of the plow wing 14 during pivoting of the plow blade 12. For example, the first end 106 of the flexible cable 104 can be connected to the A-frame 24 at a location forward of the vertical pivot axis B of the plow blade 12 and between the vertical pivot axis B of the plow blade 12 and the first end 16 of the plow blade 12, and the second end 108 of the flexible cable 104 can be connected to the first plow wing 14 at a location rearward of the pivot axis of the first plow wing 14 relative to the blade 12. Such an arrangement places the first flexible cable 104 in tension when the plow blade 12 is in the first position, whereas the first flexible cable 104 is slack when the plow blade 12 is in the center and second positions.

An exemplary, illustrative, and non-limiting manner of connecting the first plow wing 14 to the blade 12 and the first flexible cable 104 to the first plow wing 14 and to the A-frame 24 will now be described with general reference to FIGS. 3A-7, and with particular reference to FIGS. 3A-4B. First plow wing 14 includes a pair of vertically spaced plates 120, 122 on a rear side thereof. The first end 16 of plow blade 12 includes a pair of vertically spaced plates 136, 138 on a rear side thereof. A pivot pin 140 passes through respective holes in the plates 120, 122, 136, and 138 to pivotally mount the first plow wing 14 to the plow blade 12. Plow blade 12 includes a number of stiffening ribs on a back side thereof, one of which is shown at 150. For clarity, portions of the rib 150 have been removed in FIGS. 3A-4B. A stop or bumper 152 is mounted to plates 120, 122 at an outer location on plates 120, 122 and contacts an outer side of rib 150 to limit pivoting travel of first plow wing 14 rearwardly so as to be generally parallel to the plow blade 12 when the blade 12 is in the first position. Another stop or bumper 160 is mounted to plates 120, 122 at an inner location on plates 120, 122 and contacts a plate 162 mounted on an inner side of rib 150 to limit pivoting travel of first plow wing 14 forwardly when the blade 12 is in the center and second positions. Bumpers 152 and 160 can be fabricated of, for example, Ultra High Molecular Weight Polyethylene.

A spring guide 170 includes a sleeve or cylinder 172 with an L-shaped plate 174 fixedly secured to an outer end thereof. L-shaped plate 174 has a pair of vertically spaced links 176, 178 fixedly secured on their inner ends to the L-shaped plate 174 and pivotally secured on their outer ends to the plates 120, 122 with a pin 180 passing through respective holes in the links 176, 178 and plates 120, 122. First flexible cable 104 passes through sleeve or cylinder 172 and through a hole in L-shaped plate 104. A threaded fitting 190 on the second end 108 of the first flexible cable 104 carries a first adjustment nut 192 and a second lock nut 194.

Compression spring 99 is positioned between the outer surface of another of the blade ribs 198 and the inner surface of the L-shaped plate 174 of the spring guide 170, with the sleeve 172 of the spring guide 170 positioned generally in the center of the compression spring 99. With sleeve 172 of spring guide 170 positioned within compression spring 99 and first flexible cable 104 positioned within sleeve 172 of spring guide 170, all three elements (compression spring 99, sleeve 172, and first flexible cable 104) are substantially coaxial.

Figure 3A:
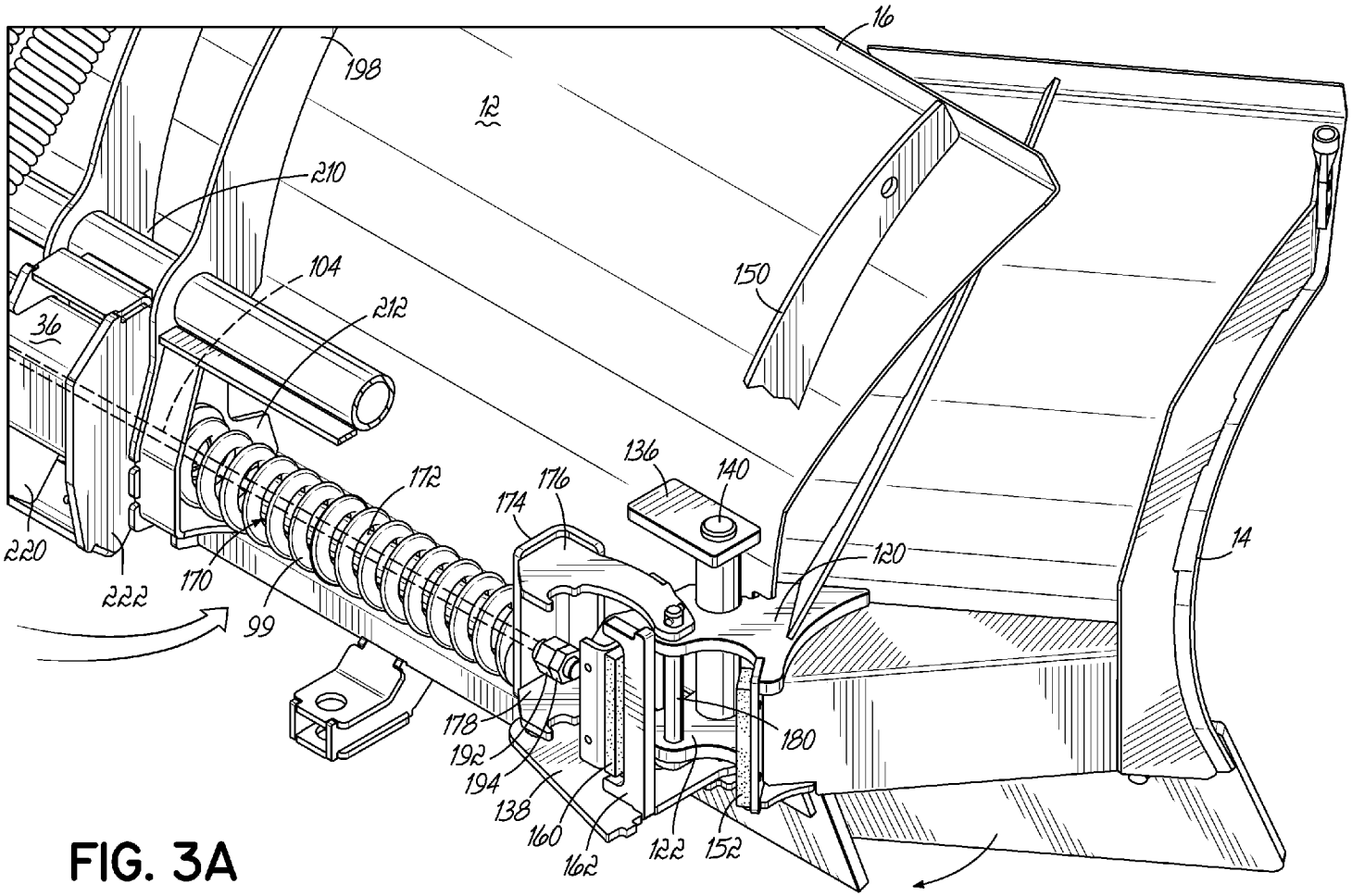
FIG. 3A is an enlarged rear perspective view of the plow assembly in the FIG. 2A position showing the first end of the plow blade with the first plow wing angled forwardly relative to the plow blade from a vantage point right of the first plow wing.
Figure 3B:
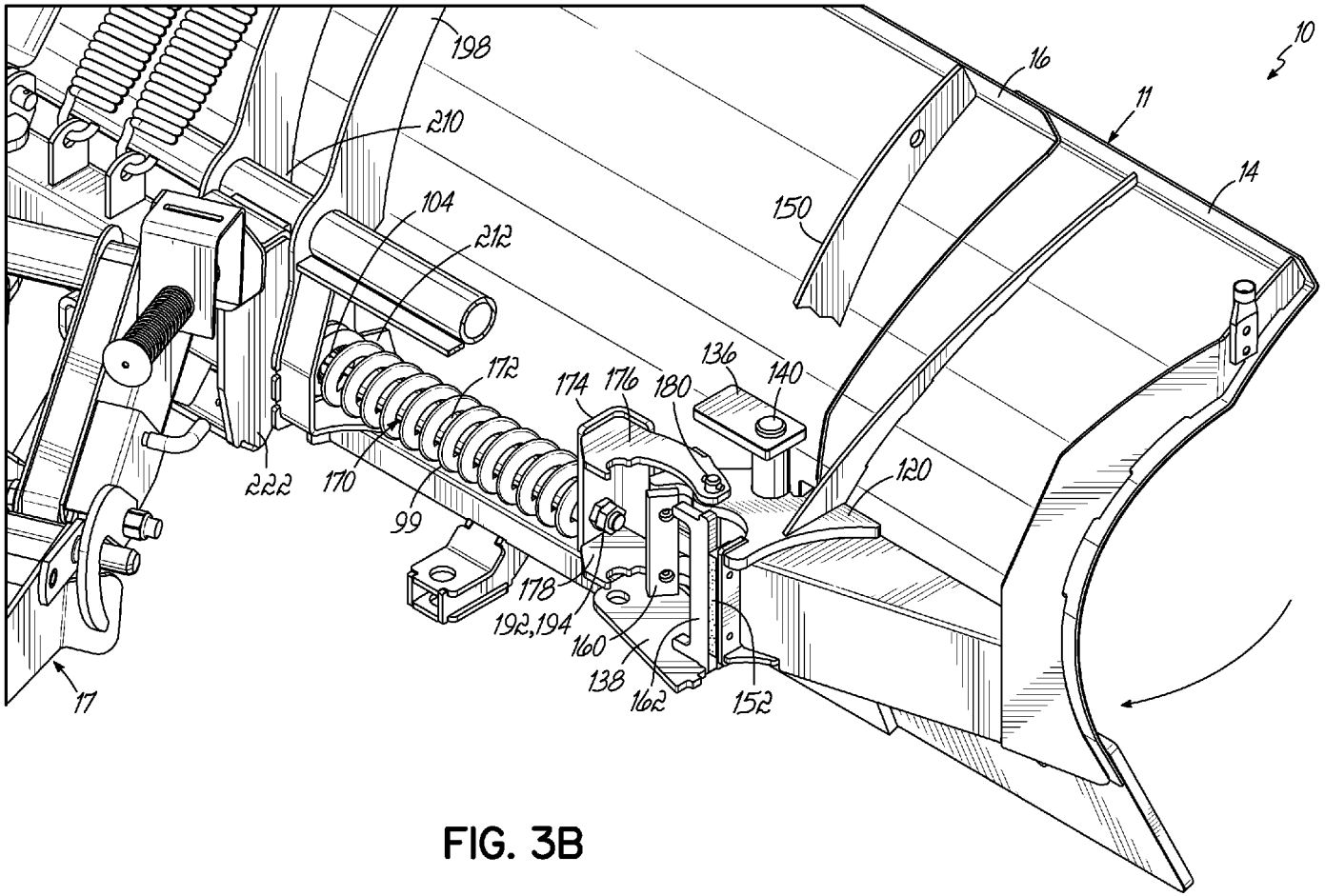
FIG. 3B is an enlarged rear perspective view of the plow assembly in the FIG. 2B position showing the first end of the plow blade with the first plow wing generally parallel to the plow blade from a vantage point right of the first plow wing.
Figure 4A:
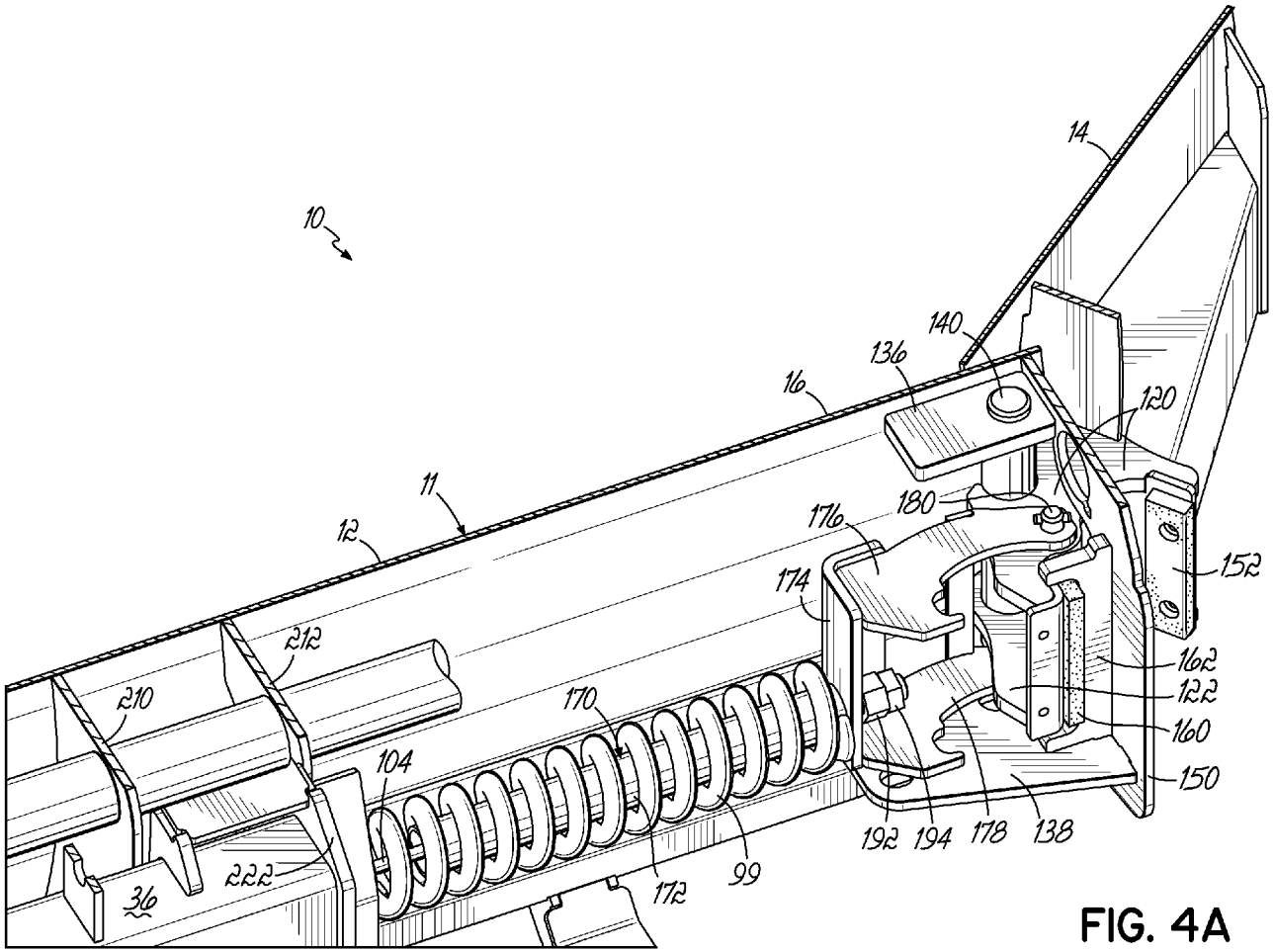
FIG. 4A is a view similar to FIG. 3A but further enlarged and from a vantage point left of the first plow wing.
Figure 4B:
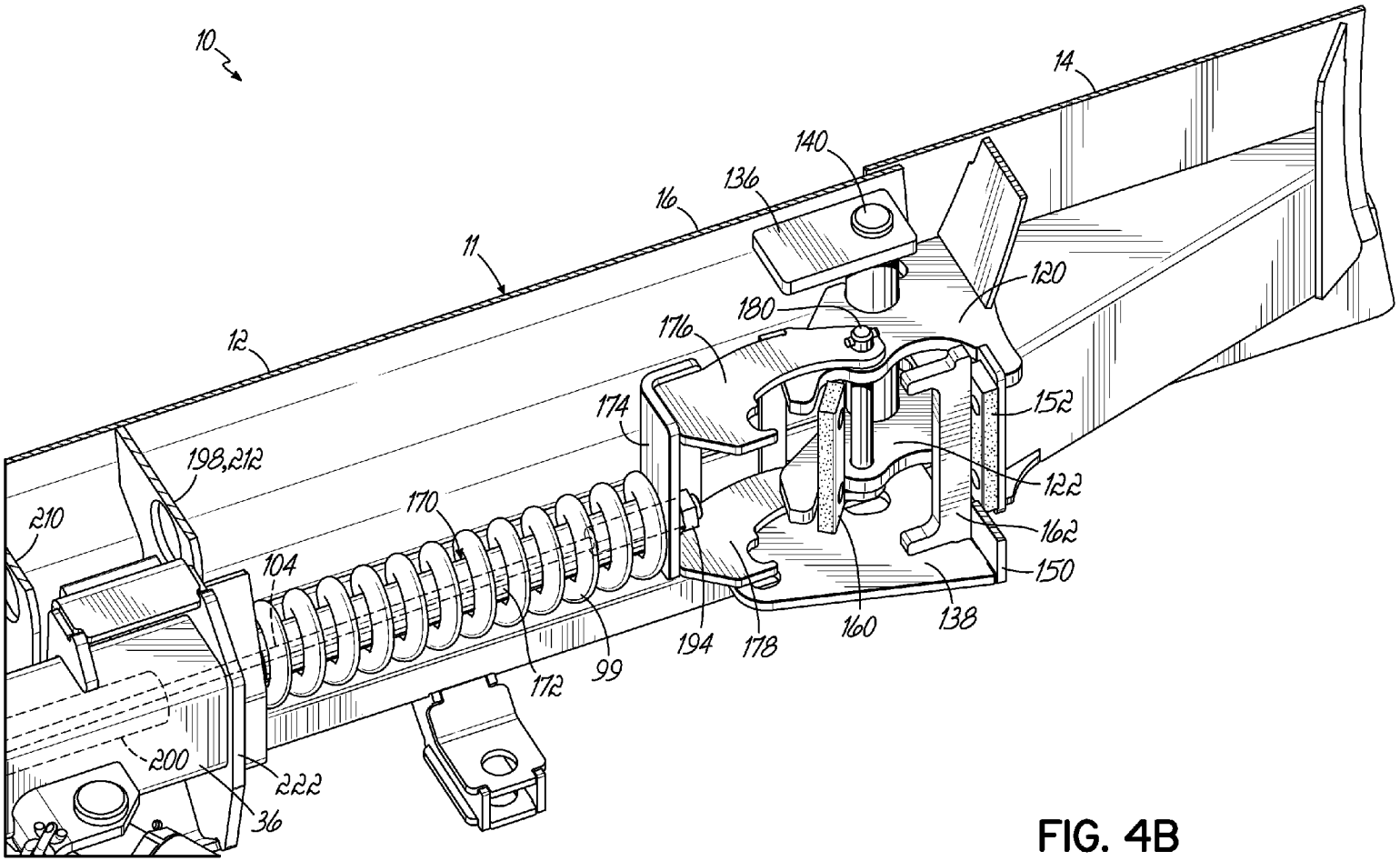
FIG. 4B is a view similar to FIG. 3B but further enlarged and from a vantage point left of the first plow wing.

With the above arrangement, compression spring 99 thus normally biases first plow wing 14 through L-shaped plate 174, links 176, 178, and plates 120, 122 to the forwardly angled position (FIGS. 3A and 4A), whereas pivoting of plow blade 12 from the center position to the first position pulls first plow wing 14 through nuts 192, 194, L-shaped plate 174, links 176, 178, and plates 120, 122 so as to pivot the first plow wing 14 to the generally parallel position relative to plow blade 12 (FIGS. 3B and 4B).

Figure 6:
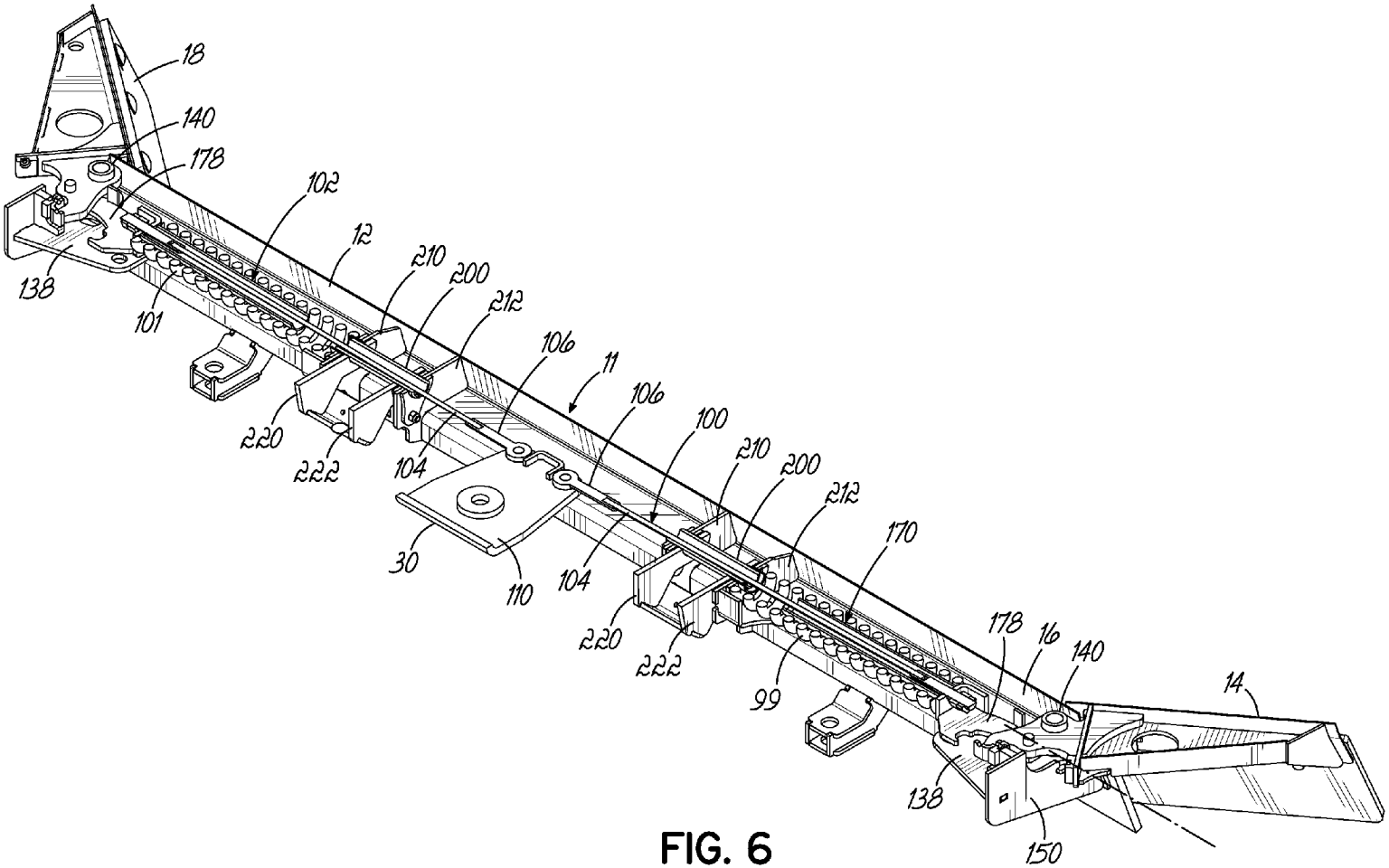
FIG. 6 is a rear perspective view of a portion of the plow assembly shown in FIG. 5.
Figure 7:
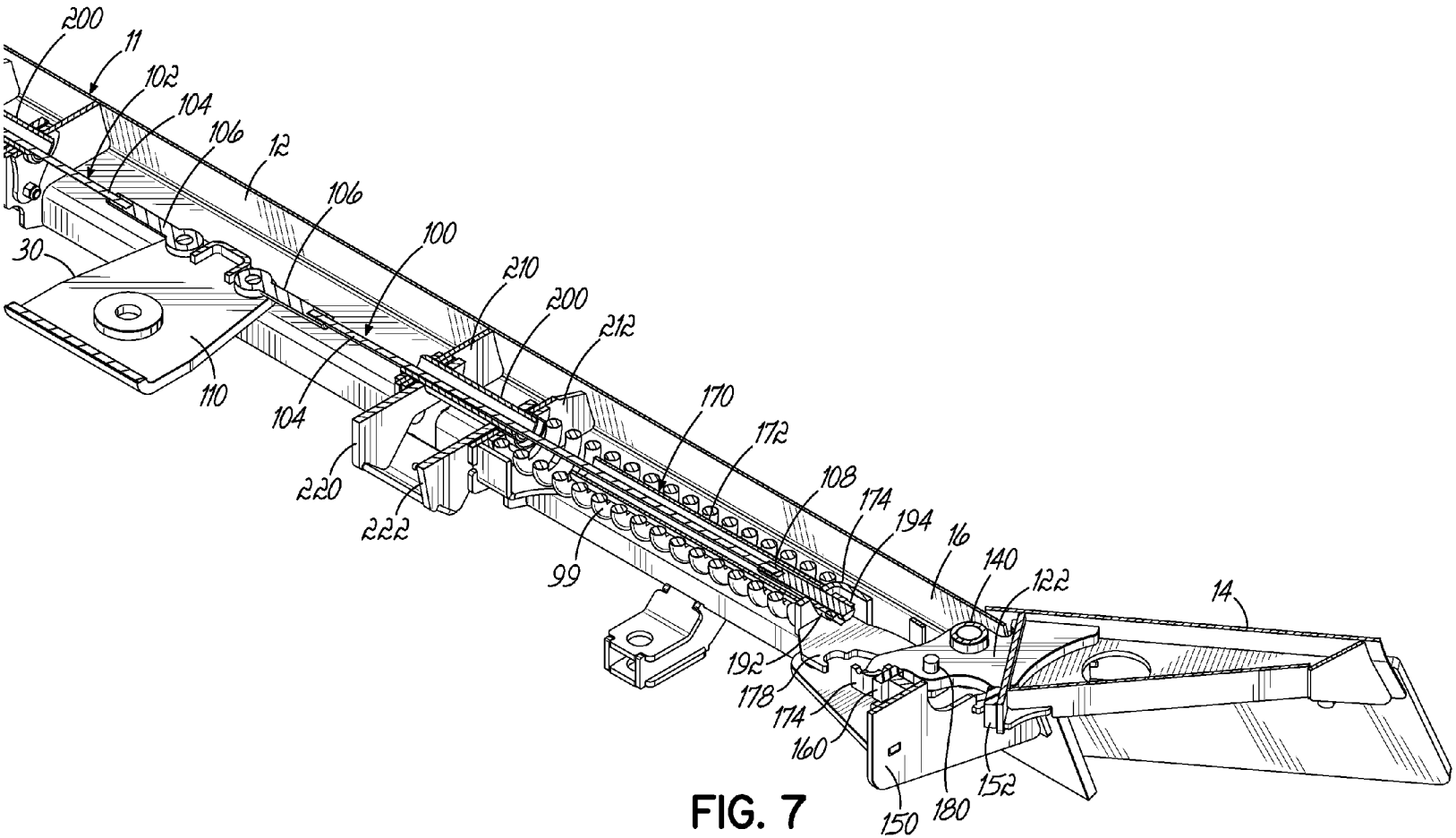
FIG. 7 is a view similar to FIG. 6 but enlarged.

As discussed briefly above, plow blade 12 is pivotally mounted to pivot beam 36 so as to permit the plow blade 12 to pivot relative to the vehicle about a generally horizontal trip pivot axis D generally transverse to the vehicle longitudinal axis A, thereby permitting the plow blade 12 to "trip" in the event that it strikes an obstruction during plowing. Referring now to FIGS. 5-7, it will be seen that pivot beam 36 is pivoted to plow blade 12 for pivoting about the trip pivot axis D with a pair of hollow or tubular pins 200, 200, each of which passes through respective holes in a pair plates 210, 212 on the plow blade 12 and in a pair of plates 220, 222 on the pivot beam 36. Trip return springs 230 are operable between pivot beam 36 and blade 12 to return blade 12 to its "pre-trip" orientation, and hydraulic damper (shock absorber) 232 controls the speed of return of the blade 12 (FIGS. 1B-2C). The hollow or tubular nature of pins 200 allows first flexible cable 104 to extend in a straight line from its attachment point 106 to plate 110 of A-frame 24, through pin 200, through compression spring 99, to its attachment point 108 to L-shaped plate 174 of spring guide 170. The result is that the flexible cable 104 extends coaxially relative to the blade trip pivot axis and the compression spring 99 from its attachment point to the A-frame 24 to its attachment point to the first plow wing 14.

The plow of the present invention provides a number of improvements over and above the plows of the aforementioned '227 patent and '434 publication. First, the plow of the '227 patent includes a hydraulic damper (shock absorber) positioned co-axially within the compression spring that acts between the plow blade and plow wing to bias the plow wing forwardly. The hydraulic damper was included to limit the angular velocity of the wing when the spring returns the wing to the forwardly angled position after being forced rearwardly due to contacting an obstacle during plowing.

With the hydraulic damper occupying the space in the center of the compression spring, the wing actuation cable was positioned aft of the wing spring. Consequently, connecting the wing actuation cable to the A-frame, passing it through the tubular or hollow blade trip pivot pin, and then extending it outwardly in a straight line toward the wing caused the end of the cable to be positioned too far behind the wing to enable a direct connection of the cable to the wing. Accordingly, a fairly complex linkage mechanism was required to connect the wing actuation cable to the wing in the appropriate location so as to properly apply cable force to the wing behind the wing pivot.

With the plow of the present invention, since no hydraulic dampers are included, the wing actuation cable can extend in a straight line from the A-frame, through the tubular blade trip pivot pin, through the wing biasing compression spring, and to the wing attachment point, thus resulting in the cable, blade trip pivot axis, and compression spring all being coaxial. The plow design of the present invention is thus more compact (fore to aft) in that it brings the blade rearwardly, so as to axially align the wing compression springs with the transverse horizontal trip pivot axis, and thus closer to the blade vertical pivot axis. This reduces the moment loads on the support frame assembly transmitted to it by the plow blade at the blade vertical pivot axis thus reducing wear and tear. In addition, the plow design of the present invention is simpler in that it eliminates a number of parts thereby resulting in a less expensive plow.

With respect to the plow of the '434 publication, with the connecting member connecting the plow wing to the A-frame being a rigid link that not only pulls the wing rearwardly to the parallel position but also pushes (drives) the wing forwardly to the angled position, significant compressive loads are developed in the link that must be accounted for thus presenting challenges in the overall design. With the plow of the present invention, all compressive loads in the connecting member are eliminated since the connecting member (flexible cable) does not drive the wing forwardly but rather a compression spring biases the wing forwardly.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. Accordingly, the scope of the invention shall be limited only by the following claims and their equivalents.

What is claimed is:

1. A plow assembly for attachment to a vehicle, the vehicle having a longitudinal axis, said plow assembly comprising:

a plow blade having first and second ends, a first plow wing pivotally mounted to said first end of said plow blade, a plow support adapted to be operably mounted to the vehicle, said plow blade being operably pivotally mounted to said plow support to permit said plow blade to pivot relative to the vehicle about a generally vertical axis between a center position, where said plow blade is positioned generally perpendicular to the longitudinal axis of the vehicle, and a first position, where said first end of said plow blade is pivoted toward the vehicle, and between said center position and a second position, where said second end of said plow blade is pivoted toward the vehicle, said first plow wing being biased by a first compression spring operable between said first plow wing and said plow blade so as to be angled forwardly relative to said plow blade when said plow blade is in said center position, and a first connecting member connected to said first plow wing, passing through said first compression spring generally coaxially therewith, and connected to said plow support, said first connecting member configured to pivot said first plow wing relative to said plow blade during pivoting of said plow blade from said center position to said first position such that when said plow blade is in said first position said first plow wing is generally parallel to said plow blade.

2. The plow assembly of claim 1 wherein said first connecting member comprises a first flexible cable.

3. The plow assembly of claim 2 wherein said first flexible cable has a first end connected to said plow support at a location forward of the generally vertical pivot axis and between the generally vertical pivot axis and said first end of said plow blade, and wherein said first flexible cable has a second end connected to said first plow wing at a location rearward of a pivot axis of said first plow wing.

4. The plow assembly of claim 2 wherein said first flexible cable is in tension when said plow blade is in said first position and is slack when said plow blade is in said second position.

5. The plow assembly of claim 2 wherein said plow support comprises an A-frame having a forward end and a rearward end, said plow blade operably pivotally mounted to said forward end of said A-frame, said rearward end of said A-frame adapted to be operably mounted to the vehicle.

6. The plow assembly of claim 5 wherein said plow blade is pivotally mounted to a pivot beam so as to permit said plow blade to pivot relative to the vehicle about a generally horizontal axis generally transverse to the vehicle longitudinal axis to trip in the event said blade strikes an obstruction during plowing, and said pivot beam is pivotally mounted to said A-frame for pivoting movement about the generally vertical axis.

7. The plow assembly of claim 6 wherein said first compression spring, said first flexible cable, and the generally horizontal trip pivot axis are generally coaxial.

8. The plow assembly of claim 6 further comprising:

a second plow wing pivotally mounted to said second end of said plow blade, said second plow wing being biased by a second compression spring operable between said second plow wing and said plow blade so as to be angled forwardly relative to said plow blade when said plow blade is in said center position, and a second connecting member connected to said second plow wing, passing through said second compression spring generally coaxially therewith, and connected to said plow support, said second connecting member configured to pivot said second plow wing relative to said plow blade during pivoting of said plow blade from said center position to said second position such that when said plow blade is in said second position said second plow wing is generally parallel to said plow blade.

9. The plow assembly of claim 8 wherein said second connecting member comprises a second flexible cable.

10. The plow assembly of claim 9 wherein said second flexible cable has a first end connected to said plow support at a location forward of the generally vertical pivot axis and between the generally vertical pivot axis and said second end of said plow blade, and wherein said second flexible cable has a second end connected to said second plow wing at a location rearward of a pivot axis of said second plow wing.

11. The plow assembly of claim 9 wherein said second flexible cable is in tension when said plow blade is in said second position and is slack when said plow blade is in said first position.

12. The plow assembly of claim 11 wherein said second compression spring, said second flexible cable, and the generally horizontal trip pivot axis are generally coaxial.

13. The plow assembly of claim 6 further comprising a first actuator connected to said A-frame and to said pivot beam between the longitudinal axis of the vehicle and said first end of said plow blade, and a second actuator connected to said A-frame and to said pivot beam between the longitudinal axis of the vehicle and said second end of said plow blade, for pivoting said pivot beam about the generally vertical axis.

14. A plow assembly for attachment to a vehicle, the vehicle having a longitudinal axis, said plow assembly comprising:

a plow blade having first and second ends and being pivoted to a pivot beam to permit said plow blade to pivot relative to the vehicle about a generally horizontal trip pivot axis generally transverse to the vehicle longitudinal axis, a first plow wing pivotally mounted to said first end of said plow blade, an A-frame adapted to be operably mounted to the vehicle, said pivot beam being pivotally mounted to said A-frame to permit said pivot beam and plow blade to pivot relative to the vehicle about a generally vertical axis between a center position, where said plow blade is positioned generally perpendicular to the longitudinal axis of the vehicle, and a first position, where said first end of said plow blade is pivoted toward the vehicle, and between said center position and a second position, where said second end of said plow blade is pivoted toward the vehicle, said first plow wing being biased by a first compression spring operable between said first plow wing and said plow blade so as to be angled forwardly relative to said plow blade when said plow blade is in said center position, and a first flexible cable connected to said first plow wing and to said A-frame, said first flexible cable configured to pivot said first plow wing relative to said plow blade during pivoting of said plow blade from said center position to said first position such that when said plow blade is in said first position said first plow wing is generally parallel to said plow blade, said first compression spring, said first flexible cable, and the generally horizontal trip pivot axis of said plow blade being generally coaxial.

15. The plow assembly of claim 14 further comprising:

a second plow wing pivotally mounted to said second end of said plow blade, said second plow wing being biased by a second compression spring operable between said second plow wing and said plow blade so as to be angled forwardly relative to said plow blade when said plow blade is in said center position, and a second flexible cable connected to said second plow wing and to said A-frame, said second flexible cable configured to pivot said second plow wing relative to said plow blade during pivoting of said plow blade from said center position to said second position such that when said plow blade is in said second position said second plow wing is generally parallel to said plow blade, said second compression spring, said second flexible cable, and the generally horizontal trip pivot axis of said plow blade being generally coaxial.

* * * * *